US005497834A

United States Patent [19]

Onuki

[11] Patent Number: 5,497,834

[45] Date of Patent: Mar. 12, 1996

[54] SPRINKLER HEAD WITH PLATE FOR ABSORBING AND INDICATING SHOCKS THERETO

[75] Inventor: Hiroshi Onuki, Iwate, Japan

[73] Assignee: Senju Sprinkler Company Limited, Tokyo, Japan

[21] Appl. No.: 235,197

[22] Filed: Apr. 29, 1994

Related U.S. Application Data

[63] Continuation of Ser. No. 947,273, Sep. 18, 1992, abandoned.

[30] Foreign Application Priority Data

Sep. 19, 1991 [JP] Japan ..... 3-083679 U

[51] Int. Cl.[6] ..... A62C 37/12

[52] U.S. Cl. ..... 169/37

[58] Field of Search ..... 169/37, 38, 39, 169/40, 41, 51, 57, 58, 90

[56] References Cited

U.S. PATENT DOCUMENTS

| | | | |
|---|---|---|---|
| 873,651 | 12/1907 | Asmus | 169/40 |
| 1,182,773 | 5/1916 | Kleidmann | 169/39 |
| 1,253,019 | 1/1918 | Fee | 169/39 X |
| 1,412,172 | 4/1922 | Duley | 169/39 |
| 1,469,336 | 10/1923 | Rowley | 169/51 |
| 3,716,103 | 2/1973 | Tanaka et al. | 169/42 |
| 3,797,746 | 3/1974 | Gray et al. | 169/37 X |
| 4,585,069 | 4/1986 | Whitaker | 169/37 |
| 4,651,832 | 3/1987 | Kubo | 169/39 |
| 4,660,648 | 4/1987 | Zen | 169/38 |
| 4,997,963 | 12/1990 | Simons | 169/37 |

FOREIGN PATENT DOCUMENTS

| | | | |
|---|---|---|---|
| 907460 | 8/1972 | Canada | 169/37 |
| 2026858 | 2/1980 | United Kingdom | 169/40 |
| 2027340 | 2/1980 | United Kingdom | 169/40 |

*Primary Examiner*—Andrew C. Pike
*Attorney, Agent, or Firm*—Tarolli, Sundheim & Covell

[57] ABSTRACT

A sprinkler head has a shock absorber. The shock absorber may be a heat collection plate disposed below a thermosensitive part of the sprinkler. The heat collection plate may be formed with a recess or at least one notch around an attachment portion to which it may be attached to the sprinkler head. The recess or notch serves to reduce strength of the heat collection plate, whereby the heat collection plate may be easily deformed upon application of a shock or external force thereto. Thus, any external force or shock is prevented from being transmitted to the thermosensitive part. Deformation of the heat collection plate also facilitates visual recognition of a sprinkler head to which external force has been given.

15 Claims, 4 Drawing Sheets

SPRINKLER HEAD WITH PLATE FOR ABSORBING AND INDICATING SHOCKS THERETO

This is a continuation of application Ser. No. 07/947,273, filed on Sep. 18, 1992, now abandoned.

FIELD OF THE INVENTION

The invention relates to a fire extinguishing sprinkler head, and more particularly to such a sprinkler head having a thermosensitive part which is oriented downwardly when the sprinkler head is attached to a ceiling.

BACKGROUND OF THE INVENTION

Three types of sprinkler heads are known in the art, a "frame yoke" type which has a deflector disposed at the tip of a frame in a horseshoe configuration; an "embedded" type which has a deflector adapted to be lowered a predetermined distance from within a frame when fire occurs; and a type in which a plurality of holes or slits are provided in a deflector.

The sprinkler head of the frame yoke type significantly protrudes from a surface of ceiling, so that it is not satisfactory in an esthetic sense. Further, it is easily damaged by an object impacting against the sprinkler head after installation onto the ceiling. The sprinkler heads of the embedded type and the type which has a plurality of holes or slits in the deflector, on the other hand, do not significantly protrude from the surface of ceiling, so that they are satisfactory in an esthetic sense. Furthermore, they are not easily damaged by an impact of an object.

It should be noted, however, that the sprinkler heads of a embedded type and the type which has a plurality of holes or slits in the deflector have disadvantages in that a thermosensitive part thereof tends to be broken easily if external force or shock is given thereto, since such thermosensitive part is located at a lower part of the sprinkler head. On the other hand, the thermosensitive part of the sprinkler head of the frame-yoke type is enclosed within a frame, so that it may be kept undamaged even if external force or shock is given to the sprinkler head.

An example of prior art sprinkler heads of the embedded type is shown in FIGS. 4 and 5, for the purpose of illustrating its construction.

A sprinkler head of the embedded type includes a main body 1, a frame 2, a valve 3, a deflector 4, and a thermosensitive part 5.

The main body 1 includes a central bore 6 for introducing water therein. A lower portion of the main body 1 constitutes a valve seat 7. An upper portion of the main body 1 includes a male-threaded portion 8 formed in the outer periphery thereof. The lower end of the main body 1 constitutes a flange 9.

The frame 2 is of a cylindrical configuration. The lower end of the frame 2 constitutes an inner flange 10. The upper end of the frame 2 is threadingly engaged with the flange 9 of the main body 1.

The valve 3 is sealingly engaged with the valve seat 7 of the main body. A deflector 4 is positioned below the valve 3. The valve 3 is supported by the thermosensitive part 5 through a guide post 11.

The thermosensitive part is disposed at a lower part of the sprinkler head. Construction of such a thermosensitive part is well known in the art (see Japanese patent Publication No. 58-36985, for example), and hence it is believed no further explanation thereof necessary. A heat collection plate 12 is attached to the lower end of the thermosensitive part 5. It is to be noted that a heat collection plate attached to prior art sprinkler heads is constituted by a member of simple cup-shaped configuration.

It should be understood that the thermosensitive part 5, which may detect occurrence of fire and or destroy itself in response thereto, is the most important part of the sprinkler head. This is because that the thermosensitive part 5 should be assembled or destroyed in a predetermined period of time in response to a temperature ranging from 72 to 96 degrees Celsius upon occurrence of fire, while, during normal state, i.e., occurrence of no fire, it should support the valve sealingly engaged with the valve seat of the sprinkler head so as to prevent any leakage of extinguishing agent therethrough.

It should be noted, however, that, when external force or shock is given to the thermosensitive part, displacement or misalignment between several parts constituting the thermosensitive part occurs. Thus, when such a damaged sprinkler head, which has been connected to a piping within a ceiling, is pressurized by extinguishing agent introduced thereinto from the piping, may be erroneously actuated or disassembled, notwithstanding that no fire occurs in reality. Apart from such an erroneous actuation, such a damaged sprinkler head tends to permit leakage of extinguishing agent due to the fact that the valve is disengaged from the valve seat, thus causing office automation equipment or furniture, which is rather expensive, to be wetted by extinguishing agent.

If it is possible to visually recognize the fact that the thermosensitive part has been damaged, a sprinkler head having such a damaged part may be replaced in order to prevent the sprinkler head from causing erroneous actuation or leakage (collectively referred to as "erroneous actuation" hereinbelow). Conventional sprinkler heads include, however, a heat collection plate disposed below the thermosensitive part which is relatively rigid. Thus, such a heat collective plate deforms slightly when a shock or external force is applied thereto. Such a slight deformation is not easily recognized. Accordingly, such a damaged sprinkler head is usually installed onto a ceiling since no remarkable change could be recognized visually, whereby erroneous actuation of the sprinkler may be caused afterward.

SUMMARY OF THE INVENTION

Accordingly, it is an object of the invention to provide a sprinkler head which is designed: to prevent the thermosensitive part from becoming disassembled or partly disassembled even if external force or shock is given thereto during transportation or installation thereof; to prevent erroneous actuation of such damaged sprinkler heads when they are installed; and to be significantly deformed when subjected to a small shock to visually indicate to that effect so that they may be replaced.

In order to achieve the above object, the present invention provides a sprinkler head having a thermosensitive part at a lower portion thereof wherein a shock absorbing member is disposed at the lower end of the thermosensitive part.

According to one aspect of the invention, the shock absorbing member mounted on the thermosensitive part may be a heat collection plate which is capable of effectively collecting heat upon occurrence of fire so as to transmit the heat to a thermosensitive element of a low-melting point alloy. In order to prevent shock or force exerted to the heat collection plate from being transmitted to the thermosensitive part, the heat collection plate is weakened at a portion around an attachment portion to which the heat collection plate is attached. To this end, the heat collection plate is thinned or formed with a plurality of notches at a portion around the attachment portion.

BRIEF DESCRIPTION OF THE DRAWINGS

For a better understanding of the invention, and to show how the same may be carried into effect, reference will now be made, by way of example, to the accompanying drawings in which like reference numerals refer to like elements.

DETAILED DESCRIPTION OF THE PREFERRED EMBODIMENTS

The invention will be explained in detail below with reference to the accompanying drawings.

Figure 1:
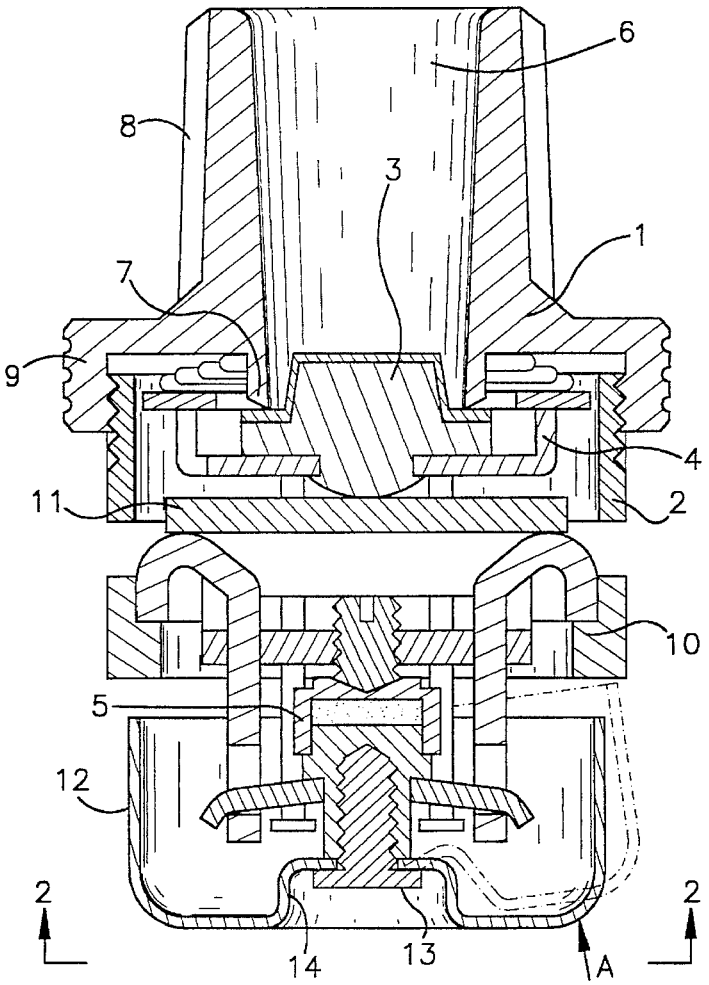
FIG. 1 is a side elevational view, in section, of a sprinkler head of an embedded type in accordance with a first embodiment of the invention.
Figure 2:
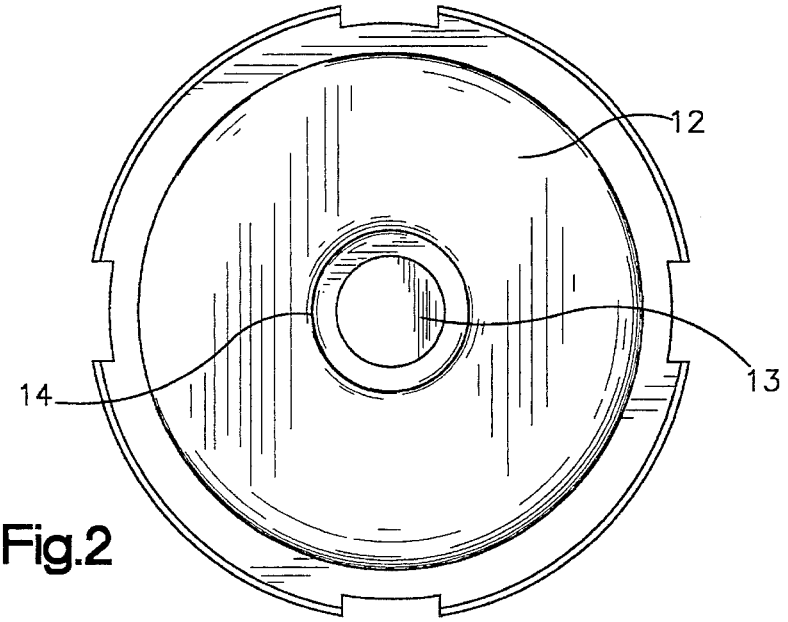
FIG. 2 is a bottom end view of the sprinkler head of an embedded type in accordance with the first embodiment of the invention.
Figure 4:
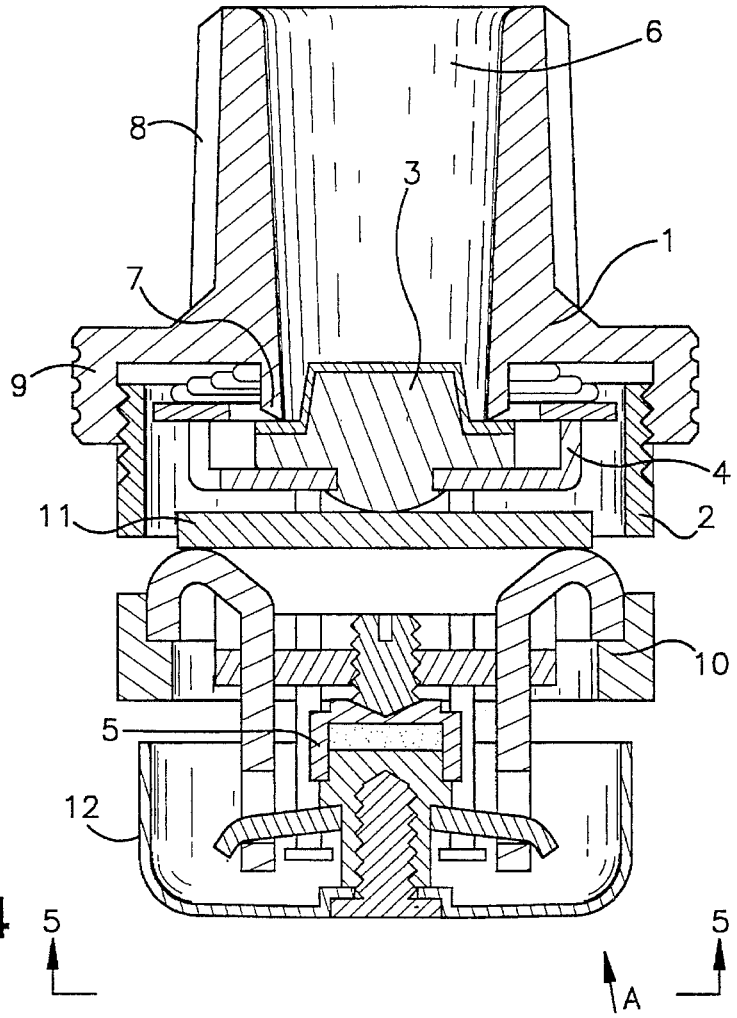
FIG. 4 is a side elevational view, in section, of a conventional sprinkler head of an embedded type.
Figure 5:
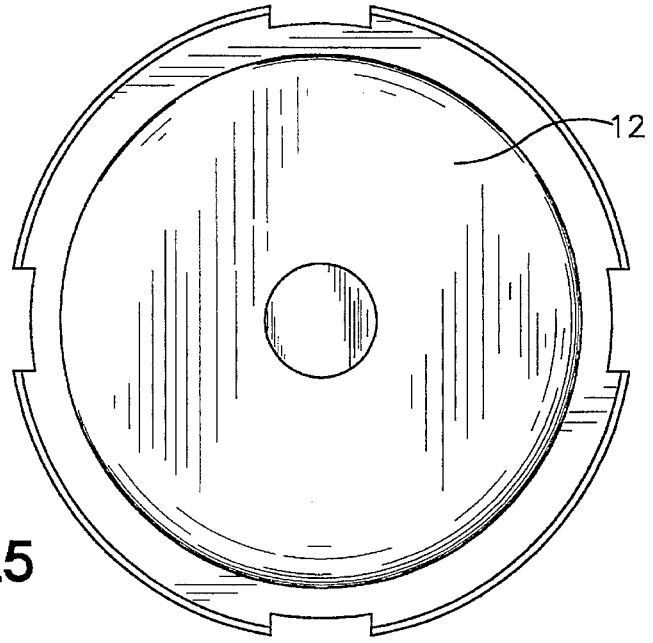
FIG. 5 is a bottom end view of the conventional sprinkler head of an embedded type shown in FIG. 4.

FIG. 1 is a side elevational view, in section, of a sprinkler head in accordance with a first embodiment of the invention. FIG. 2 is a bottom end view of the first embodiment of the invention. It is to be noted that, since construction of a sprinkler head of an embedded type has been described above, detailed explanation of such a construction is not given in the following, while designating the parts the same as that shown in FIG. 4 by the same reference numerals.

A heat collection plate 12 is attached to the lower end of a thermosensitive part 5. The heat collection plate 12 is generally cup shaped, in that it has a bottom, a circumferential wall, and an upper circumferential peripheral edge about its wide mouth. The upper circumferential periphery of the heat collection plate 12 is spaced away from the lower end of the frame 2 to permit deformation and a deflection of the portion of the heat collection plate 12 toward the lower end of the frame 2. The thermosensitive part 5 detects occurrence of fire and has elements which are exploded in response to the fire. Because the thermosensitive part 5 is well known, a detailed explanation is omitted. The heat collection plate 12 is formed with a recess 14 immediately adjacent an attachment portion 13, relative to the rest of the heat collection plate 12, on the bottom of the heat collection plate 12. Thus the formed recess serves to make the heat collection plate 12 able to be easily deformed as shown by dotted lines in FIG. 1 when external force (arrow mark A) is given thereto, since the recess 14 reduces strength of the heat collection plate. The external force A is shown to be directed from below the heat collection plate 12 upward toward the frame 2. Thus, the portion of the heat collection plate which is deflected is deflected upwardly, toward the lower end of the frame 2.

The deflected portion is conspicuous and noticeable to an observer, in that the observer can plainly see that the deflected portion has been moved, relative to the rest of the structure, to a location well away from the location that the portion occupied upon the original manufacturer. The observer does not have to examine the heat collection plate 12 closely, seeking to see some remarkably small movement of a portion which may or may not have occurred. As illustrative of this conspicuously deflected portion, FIG. 1 shows the deflected portion (in dotted lines) moved upwardly a distance greater than approximately 15% of the overall height of the heat collection plate 12, based upon relative dimensioning. Further, as illustrative of this conspicuously deflected portion, FIG. 1 shows the deflected portion pivoted such that the normally cylindrical appearance is permutated and a diameter of the now greatest extent is increased by at least 7%, based upon relative dimensioning. Moreover, the deflected portion now projects beyond a vertical plumb line extending downward along and from an outer side of the frame 2.

Figure 3:
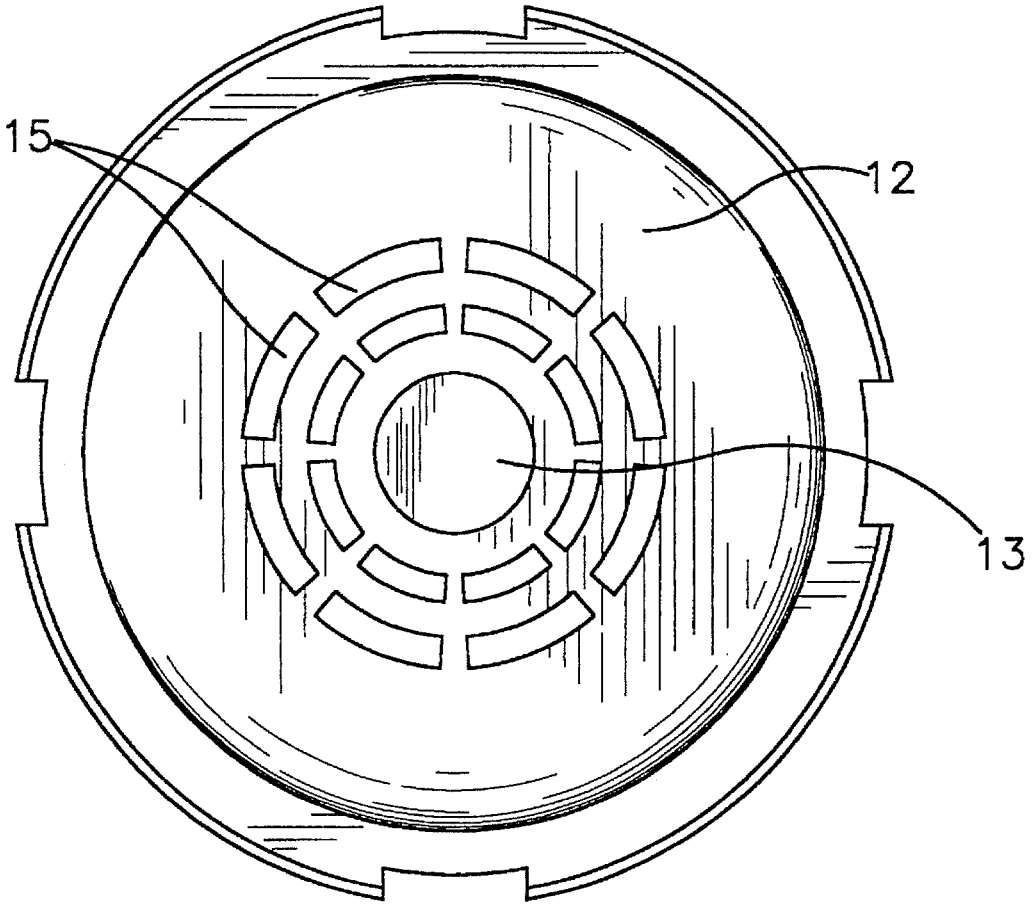
FIG. 3 is a bottom end view of a sprinkler head of an embedded type in accordance with a second embodiment of the invention.

FIG. 3 is a bottom end view of a second embodiment of the invention.

A heat collection plate 12 is attached to the lower end of the thermosensitive part 5. The heat collection plate 12 is formed with a plurality of notches 15 around an attachment portion 13. These notches 15 are on the bottom of the heat collection plate 12 and are spaced well away from the upper circumferential edge of the heat collection plate 12. Specifically, the circumferential side wall of the heat collection plate 12 separates these two structural elements. Thus, as opposed to the upper circumferential edge and the circumferential side wall, the notches 15 are immediately adjacent to the attachment portion 13. Due to the formation of the notches 15, around the attachment portion 13, the remaining area of the collection plate 12 is decreased, so that strength of the heat collection plate 12 is decreased. Thus, when external force is given to the heat collection plate 12, the heat collection plate 12 will be easily deformed.

The embodiments are described with reference to a sprinkler head of an embedded type. It should be noted, however, that the present invention may also be incorporated in sprinkle heads of a type which has a plurality of holes or slits in the deflector which includes a thermosensitive part at the lower end portion thereof.

Figure 6:
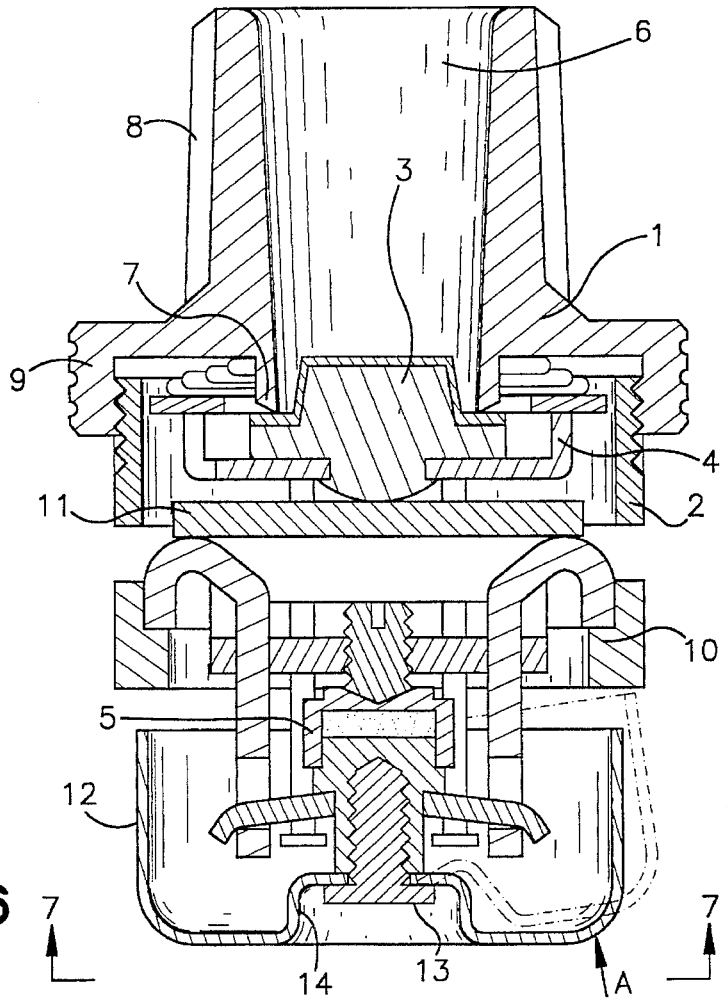
FIG. 6 is a side elevational view, in section, of a sprinkler head of another embodiment.
Figure 7:
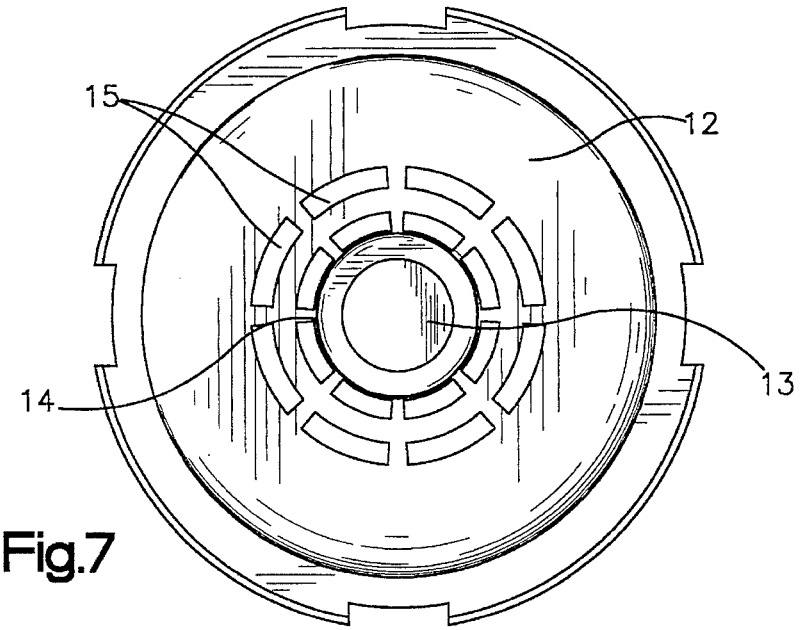
FIG. 7, is a bottom view of a sprinkler head of yet another embodiment.

The head collection plate may be formed by combining the first and second embodiments in accordance with the invention (FIG. 7). That is, the heat collection plate may include both a recess formed around the attachment portion and notches cut from the heat collection plate around the attachment portion. It is noted further that the heat collection plate may take any construction which may decrease or reduce strength of the collection plate around the attachment portion, such as by thinning (FIG. 6). Furthermore, the present invention may be embodied in various forms, other than the heat collection plate, which may absorb external shock or force.

In the sprinkler head provided with a shock absorbing means disposed at the lower end of a thermosensitive part, the thermosensitive part being the most important part, any external force or shock, which may be given to the sprinkler head during transportation thereof or upon contact with an object, may be buffered or absorbed. Thus, even if such a sprinkler head to which external force or shock has been given per se is connected with a piping within ceiling, no erroneous actuation may occur. In addition, it is possible to visually recognize such a sprinkler head that has been given eternal force or shock. Accordingly, such a damaged sprinkler head may be disposed of before installation or may be replaced after installation, so that erroneous actuation of the sprinkler head may be completely prevented.

The principles, preferred embodiments and modes of operation of the present invention have been described in the foregoing specification. The invention should not, however, be construed as being limited only to the particular form described above which is to be regarded as illustrative rather than restrictive. Variations and modifications may be made by those skilled in the art without departing from the spirit of the present invention. Accordingly, the foregoing detailed description should be regarded as exemplary in nature and not as limiting the scope of the invention set forth in the appended claims.

What is claimed is:

1. A sprinkler head for dispersing a fire extinguishing agent upon occurrence of a temperature increase due to a fire, said sprinkler head comprising:

a fixed portion for connection to a supply of the fire extinguishing agent, said fixed portion having a passage through which the fire extinguishing agent may flow;

a valve for blocking said passage;

a thermally-sensitive assembly for retaining said valve in a position to block said passage prior to occurrence of the temperature increase and for releasing said valve from the position to open said passage in response to the temperature increase;

a heat collection cover for collecting heat from a surrounding atmosphere and for conducting the heat to said thermally-sensitive assembly; and means for attaching said cover to said thermally-sensitive assembly;

said cover having a general cup shape, and having a bottom and an upper circumferential periphery about an open mouth, said means for attaching said cover to said thermally-sensitive assembly engaging said cover at a location on said bottom, said cover being spaced away from said fixed portion at said upper circumferential periphery a substantial distance for permitting conspicuous deformation of said cover, said cover including a portion having a reduced strength on said bottom for deforming upon impact of an object against said cover to conspicuously deflect another portion of said cover toward said fixed portion a substantial distance relative to an overall size of said cover to indicate the occurrence of the impact.

2. A sprinkler head as set forth in claim 1, wherein said portion of said cover having the reduced strength includes a recessed portion located immediately adjacent to said location.

3. A sprinkler head as set forth in claim 2, wherein said cover has a hollow interior, a closed end at said bottom, and an open end at said mouth, said cover has an overall height between said closed end and said open end, said cover is attached to said thermally-sensitive assembly at said closed end, said open end faces toward said fixed portion and is spaced away from said fixed portion prior to impact a distance which is on an order of 15% of the overall height of said cover, said recessed portion being located at said closed end, said recessed portion is defined by an annular bend in said cover, and said open end of said cover is movable toward said fixed portion upon occurrence of the impact.

4. A sprinkler head as set forth in claim 3 wherein said portion of said cover having the reduced strength deforms upon impact applied along a direction from below said bottom toward said fixed portion.

5. A sprinkler head as set forth in claim 1, wherein said portion of said cover having the reduced strength has a plurality of notch openings.

6. A sprinkler head as set forth in claim 5, wherein said cover has a circumferential side wall, a hollow interior, a closed end at said bottom, and an open end at said mouth, said cover has an overall height between said closed end and said open end, said cover is attached to said thermally-sensitive assembly at said closed end, said open end faces toward said fixed portion and is spaced away from said fixed portion prior to impact a distance which is on an order of 15% of the overall height of said cover, said notch openings extend through said cover and are located on said closed end annularly about said location, and said notch openings are spaced away from said open end and said mouth and are spaced away from said circumferential side wall.

7. A sprinkler head as set forth in claim 6, wherein said portion of said cover having the reduced strength deforms upon impact applied along a direction from below said bottom toward said fixed portion.

8. A sprinkler head as set forth in claim 1, wherein said cover has a hollow interior and a center opening, said thermally-sensitive assembly extends into said hollow interior, and said means for attaching said cover to said thermally-sensitive assembly includes an attachment portion of said thermally-sensitive assembly which extends through said central opening to attach said cover to said thermally-sensitive assembly.

9. A sprinkler head as set forth in claim 1, wherein said portion of said cover having the reduced strength deforms upon impact applied along a direction from below said bottom toward said fixed portion, and said deflected portion is moved a distance on an order of 15% of an overall height of said cover.

10. A sprinkler head for dispersing a fire extinguishing agent upon occurrence of a temperature increase due to a fire, said sprinkler head comprising:

a body portion for connection to a supply of the fire extinguishing agent, said body portion having a passage through which the fire extinguishing agent may flow;

a valve for blocking said passage;

a frame fixed to said body portion;

a thermally-sensitive assembly mounted on said frame for retaining said valve in a position to block said passage prior to occurrence of a temperature increase and for releasing said valve from the position to open said passage in response to the temperature increase;

a heat collection cover facing said frame and enclosing said thermally-sensitive assembly for collecting heat from a surrounding atmosphere and for conducting heat to said thermally-sensitive assembly and for indicating an occurrence of an impact of an object against said cover; and means for attaching said cover to said thermally-sensitive assembly;

said cover having an overall height, said cover having a recessed portion located immediately adjacent a point of attachment of said cover to said thermally-sensitive assembly by said means for attaching, said recessed portion providing a means for deforming to conspicuously deflect another portion of said cover by movement of a distance of at least 15% of the overall height of said cover.

11. A sprinkler head as set forth in claim 10, wherein said cover has a general cup shape, and has a bottom and an upper circumferential periphery about an open mouth, said recessed portion being located on said bottom.

12. A sprinkler head as set forth in claim 11, wherein the overall height of said cover is between said bottom and said upper circumferential periphery, said upper circumferential periphery being spaced from said frame prior to deflection a distance of at least 15% of the overall height of said cover.

13. A sprinkler head as set forth in claim 12, wherein said cover has a circumferentially extending side and has a plurality of notches located on said bottom, and said notches are located adjacent said recessed portion and are not located on said circumferentially extending side.

14. A sprinkler head comprising:

a thermally-sensitive assembly; and a cup-shaped heat collection cover having a bottom and a circumferential periphery about a open mouth, said cover being attached at an attachment portion located on said bottom to said thermally-sensitive assembly;

said cover having a recess means and a plurality of notch means for providing a portion of said cover having a reduced strength to deform upon impact against said cover to conspicuously move at least a segment of said circumferential periphery as an indication of the occurrence of the impact, said recess means being on said bottom of said cover and being formed immediately around said attachment portion, said plurality of notch means being on said bottom of said cover and located around said attachment portion, said plurality of notch means being spaced away from said circumferential periphery.

15. A sprinkler as set forth in claim 14, wherein said cover has an overall height between said bottom and an upper end of said circumferential periphery, said segment of said circumferential periphery being moved a distance on an order of 15% of the overall height of said cover.

* * * * *